US011317779B2

(12) United States Patent
Johnson et al.

(10) Patent No.: US 11,317,779 B2
(45) **Date of Patent: *May 3, 2022**

(54) ROBOTIC CLEANER WITH SWEEPER AND ROTATING DUSTING PADS

(71) Applicant: BISSELL Homecare, Inc., Grand Rapids, MI (US)

(72) Inventors: Steve M. Johnson, Hudsonville, MI (US); Todd Vantongeren, Ada, MI (US); Jake Andrew Mohan, Grand Rapids, MI (US); Adam Brown, Holland, MI (US); Eric Daniel Buehler, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 605 days.

This patent is subject to a terminal disclaimer.

(21) Appl. No.: 16/217,748

(22) Filed: Dec. 12, 2018

(65) Prior Publication Data

US 2019/0191952 A1 Jun. 27, 2019

Related U.S. Application Data

(60) Provisional application No. 62/609,449, filed on Dec. 22, 2017.

(51) Int. Cl.
*A47L 11/40* (2006.01)
*A47L 11/282* (2006.01)

(52) U.S. Cl.
CPC ..... *A47L 11/4083* (2013.01); *A47L 11/282* (2013.01); *A47L 11/4011* (2013.01); *A47L 11/4013* (2013.01); *A47L 11/4038* (2013.01); *A47L 11/4041* (2013.01); *A47L 11/4055* (2013.01); *A47L 11/4066* (2013.01);
(Continued)

(58) Field of Classification Search
CPC A47L 11/4083; A47L 11/282; A47L 11/4011; A47L 11/4013; A47L 11/4038; A47L 11/4041; A47L 11/4055; A47L 11/4066; A47L 11/4088; A47L 2201/00; A47L 2201/028; A47L 2201/04;
(Continued)

(56) References Cited

U.S. PATENT DOCUMENTS 5,815,880 A 10/1998 Nakanishi
5,894,621 A 4/1999 Kubo
(Continued)

FOREIGN PATENT DOCUMENTS

CN 204120958 U 1/2015
CN 107224251 A 10/2017
(Continued)

OTHER PUBLICATIONS

Great Britain Search Report corresponding to GB Application No. 1820131.9 dated May 30, 2019.
(Continued)

*Primary Examiner* — David Redding
(74) *Attorney, Agent, or Firm* — McGarry Bair PC

(57) ABSTRACT

An autonomous floor cleaner can include a brush chamber, a brushroll rotatably mounted in the brush chamber, a controller for controlling the operation of the autonomous floor cleaner; and a fluid delivery system with a supply tank and at least one fluid distributor configured to deposit cleaning fluid onto a surface to be cleaned.

19 Claims, 15 Drawing Sheets

(52) U.S. Cl.
CPC ..... *A47L 11/4088* (2013.01); *A47L 2201/00* (2013.01); *A47L 2201/028* (2013.01); *A47L 2201/04* (2013.01)

(58) Field of Classification Search
CPC ..... A47L 11/30; A47L 11/34; A47L 11/408; A47L 11/4063
See application file for complete search history.

(56) References Cited

U.S. PATENT DOCUMENTS

| | | | | |
|---|---|---|---|---|
| 7,320,149 | B1 | 1/2008 | Huffman et al. | |
| 8,438,695 | B2 | 5/2013 | Gilbert, Jr. et al. | |
| 9,282,867 | B2 | 3/2016 | Williams et al. | |
| 9,844,311 | B2 | 12/2017 | Zhang | |
| 2006/0185690 | A1* | 8/2006 | Song | A47L 11/34 134/21 |
| 2012/0260948 | A1* | 10/2012 | Balas | A47L 11/4022 134/21 |

FOREIGN PATENT DOCUMENTS

| | | | |
|---|---|---|---|
| EP | 3031376 | A1 | 6/2016 |
| WO | 2017037669 | A2 | 3/2017 |
| WO | 2017037673 | A1 | 3/2017 |

OTHER PUBLICATIONS

GB Intellectual Property Office, Search Report re Corresponding Application No. GB1820131.9, dated Feb. 12, 2020, 2 pages, South Wales, NP.

* cited by examiner

ROBOTIC CLEANER WITH SWEEPER AND ROTATING DUSTING PADS

CROSS-REFERENCE TO RELATED APPLICATION(S)

This application claims the benefit of U.S. Provisional Patent Application No. 62/609,449 filed Dec. 22, 2017, which is incorporated herein by reference in its entirety.

BACKGROUND

Autonomous or robotic floor cleaners can move without the assistance of a user or operator to clean a floor surface. For example, the floor cleaner can be configured to sweep dirt (including dust, hair, and other debris) into a collection bin carried on the floor cleaner or to sweep dirt using a cloth which collects the dirt. The floor cleaner can move randomly about a surface while cleaning the floor surface or use a mapping/navigation system for guided navigation about the surface. Some floor cleaners are further configured to apply and extract liquid for deep cleaning carpets, rugs, and other floor surfaces.

BRIEF SUMMARY

In one aspect, the disclosure relates to an autonomous floor cleaner. The autonomous floor cleaner includes a brush chamber, a brushroll rotatably mounted in the brush chamber, a controller for controlling the operation of the autonomous floor cleaner, and a fluid delivery system including a supply tank for storing a supply of cleaning fluid, at least one fluid distributor in fluid communication with the supply tank and configured to deposit cleaning fluid onto a surface to be cleaned, and a fluid delivery pump configured to control a flow of the cleaning fluid to the at least one fluid distributor, wherein a pulse width modulation signal powering the pump, from the controller, is further configured to provide a set flowrate of deposited cleaning fluid.

In another aspect, the disclosure relates to a floor cleaning robot. The floor cleaning robot includes an autonomously moveable housing having a front, a rear, a first side, and a second side, and a unitary assembly selectively mounted to the autonomously moveable housing, the unitary assembly including a brush chamber, a debris receptacle fluidly coupled to the brush chamber, and a supply tank for storing a supply of cleaning fluid. The floor cleaning robot also includes a brushroll having a brush assembly located in the brush chamber, at least one fluid distributor in fluid communication with the supply tank and configured to deposit cleaning fluid onto a surface to be cleaned, and a fluid delivery pump configured to control a flow of the cleaning fluid to the at least one fluid distributor, wherein the unitary assembly is configured to be selectively detached from the autonomously moveable housing by rotating the brush chamber with respect to the autonomously moveable housing and then lifting the unitary assembly to releasably detach the brush chamber from the autonomously moveable housing.

DETAILED DESCRIPTION

The disclosure generally relates to autonomous floor cleaners for cleaning floor surfaces, including hardwood, tile and stone. More specifically, the disclosure relates to devices, systems and methods for sweeping and mopping with an autonomous floor cleaner.

Figure 1:
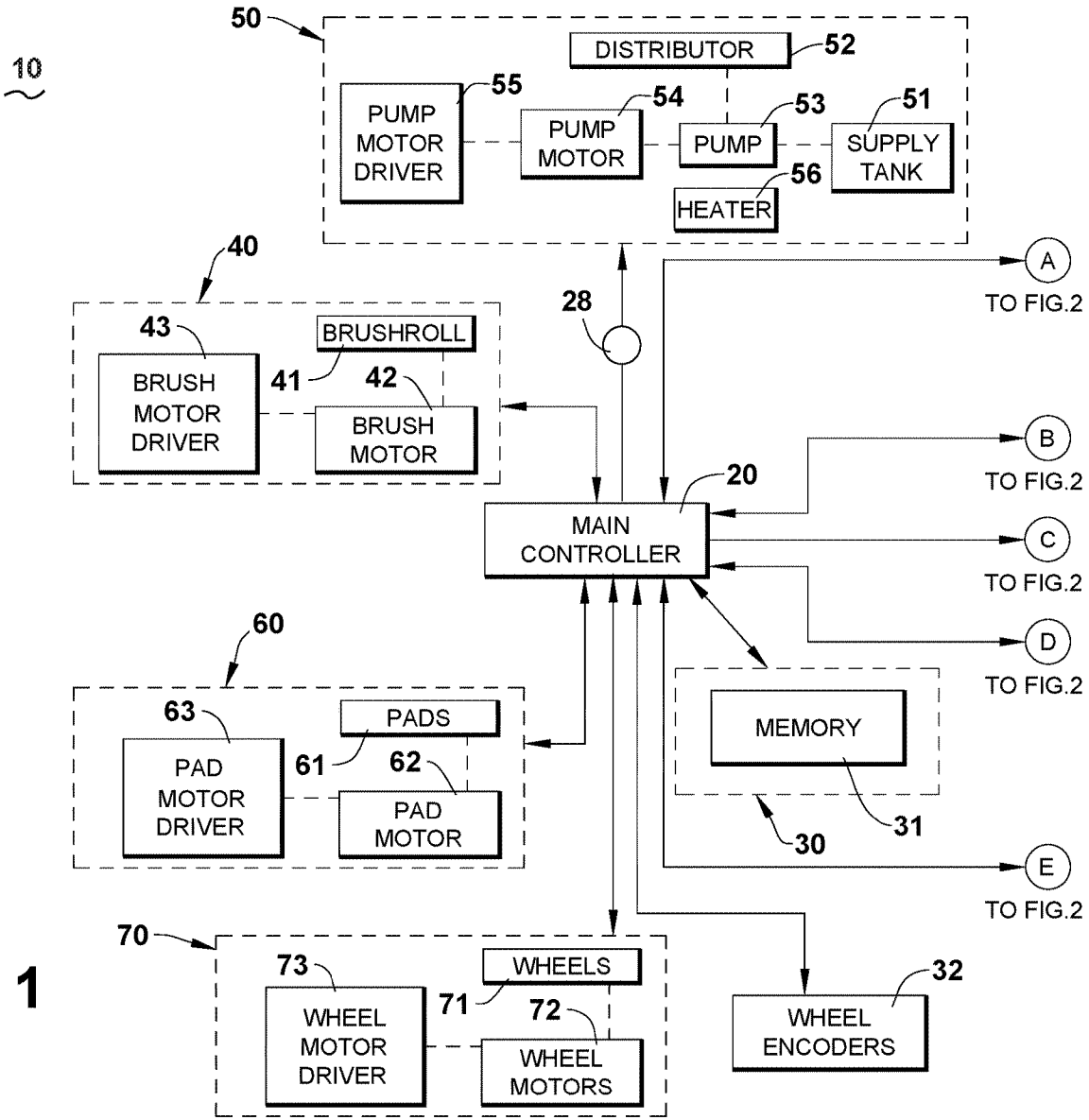
FIG. 1 is a schematic view of an exemplary autonomous floor cleaner illustrating functional systems in accordance with various aspects described herein.
Figure 2:
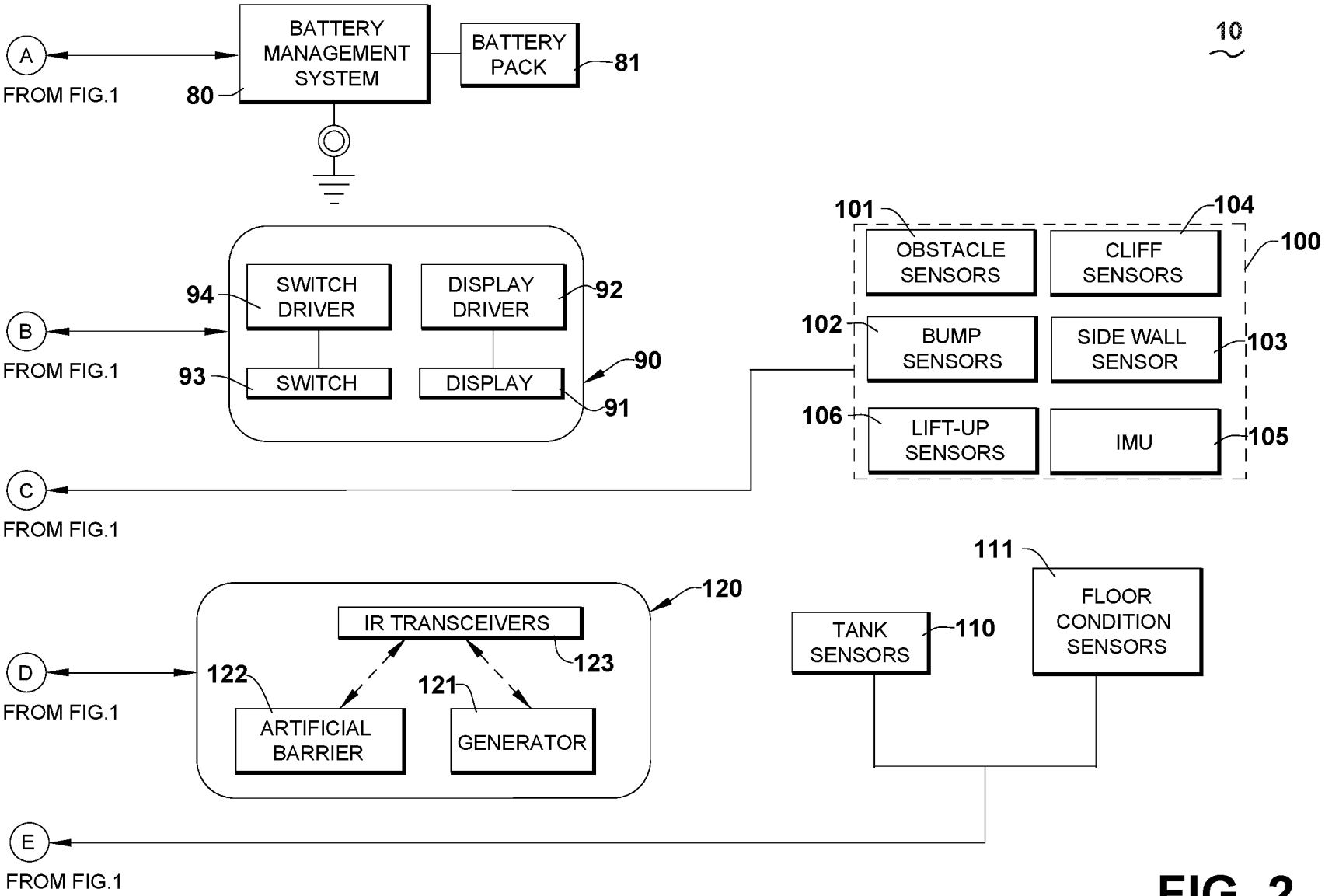
FIG. 2 is a schematic view of the autonomous floor cleaner of FIG. 1 illustrating additional functional systems in accordance with various aspects described herein.

FIGS. 1 and 2 illustrate a schematic view of an autonomous floor cleaner, such as a floor cleaning robot 10, also referred to herein as a robot 10. It is noted that the robot 10 shown is but one example of a floor cleaning robot configured to sweep as well as dust, mop or otherwise conduct a wet cleaning cycle of operation, and that other autonomous cleaners requiring fluid supply or fluid recovery are contemplated, including, but not limited to autonomous floor cleaners capable of delivering liquid, steam, mist, or vapor to the surface to be cleaned.

The robot 10 can include components of various functional systems in an autonomously moveable unit. The robot 10 can include a main housing 12 (FIG. 3) adapted to selectively mount components of the systems to form a unitary movable device. A controller 20 is operably coupled with the various functional systems of the robot 10 for controlling the operation of the robot 10. The controller 20 can be a microcontroller unit (MCU) that contains at least one central processing unit (CPU).

A navigation/mapping system 30 can be provided in the robot 10 for guiding the movement of the robot 10 over the surface to be cleaned, generating and storing maps of the surface to be cleaned, and recording status or other environmental variable information. The controller 20 can receive input from the navigation/mapping system 30 or from a remote device such as a smartphone (not shown) for directing the robot 10 over the surface to be cleaned. The navigation/mapping system 30 can include a memory 31 that can store any data useful for navigation, mapping or conducting a cycle of operation, including, but not limited to, maps for navigation, inputs from various sensors that are used to guide the movement of the robot 10, etc. For example, wheel encoders 32 can be placed on the drive shafts of wheels coupled to the robot 10 and configured to measure a distance traveled by the robot 10. The distance measurement can be provided as input to the controller 20.

In an autonomous mode of operation, the robot 10 can be configured to travel in any pattern useful for cleaning or sanitizing including boustrophedon or alternating rows (that is, the robot 10 travels from right-to-left and left-to-right on alternate rows), spiral trajectories, etc., while cleaning the floor surface, using input from various sensors to change direction or adjust its course as needed to avoid obstacles. In a manual mode of operation, movement of the robot 10 can be controlled using a mobile device such as a smartphone or tablet.

The robot 10 can also include at least the components of a sweeper 40 for removing debris particles from the surface to be cleaned, a fluid delivery system 50 for storing cleaning fluid and delivering the cleaning fluid to the surface to be cleaned, a mopping or dusting assembly 60 for removing moistened dust and other debris from the surface to be cleaned, and a drive system 70 for autonomously moving the robot 10 over the surface to be cleaned.

The sweeper 40 can also include at least one agitator for agitating the surface to be cleaned. The agitator can be in the form of a brushroll 41 mounted for rotation about a substantially horizontal axis, relative to the surface over which the robot 10 moves. A drive assembly including a separate, dedicated brush motor 42 can be provided within the robot 10 to drive the brushroll 41. Other agitators or brushrolls can also be provided, including one or more stationary or non-moving brushes, or one or more brushes that rotate about a substantially vertical axis. In addition, a debris receptacle 44 (FIG. 4) such as a dustbin can be provided to collect dirt or debris from the brushroll 41.

The fluid delivery system 50 can include a supply tank 51 for storing a supply of cleaning fluid and at least one fluid distributor 52 in fluid communication with the supply tank 51 for depositing a cleaning fluid onto the surface. The cleaning fluid can be a liquid such as water or a cleaning solution specifically formulated for hard or soft surface cleaning. The fluid distributor 52 can be one or more spray nozzles provided on the housing 12 with an orifice of sufficient size such that debris does not readily clog the nozzle. Alternatively, the fluid distributor 52 can be a manifold having multiple distributor outlets.

A pump 53 can be provided in the fluid pathway between the supply tank 51 and the at least one fluid distributor 52 to control the flow of fluid to the at least one fluid distributor 52. The pump 53 can be driven by a pump motor 54 to move liquid at any flowrate useful for a cleaning cycle of operation.

Various combinations of optional components can also be incorporated into the fluid delivery system 50, such as a heater 56 or one or more fluid control and mixing valves. The heater 56 can be configured, for example, to warm up the cleaning fluid before it is applied to the surface. In one embodiment, the heater 56 can be an in-line fluid heater between the supply tank 51 and the distributor 52. In another example, the heater 56 can be a steam generating assembly. The steam assembly is in fluid communication with the supply tank 51 such that some or all the liquid applied to the floor surface is heated to vapor.

The dusting assembly 60 can be utilized to disperse the distributed fluid on the floor surface and remove moistened dust and other debris. The dusting assembly 60 can include at least one pad 61 that can optionally be rotatable. For example, the at least one pad 61 can be driven to rotate about a vertical axis that intersects with the center of the respective pad 61. A drive assembly including at least one pad motor 62 can be provided as part of the dusting assembly 60. Each pad 61 can be optionally be detachable for purposes of cleaning and maintenance.

The drive system 70 can include drive wheels 71 for driving the robot 10 across a surface to be cleaned. The drive wheels can be operated by a common wheel motor 72 or individual wheel motors coupled with the drive wheels by a transmission, which may include a gear train assembly or another suitable transmission. The drive system 70 can receive inputs from the controller 20 for driving the robot 10 across a floor, based on inputs from the navigation/mapping system 30 for the autonomous mode of operation or based on inputs from a smartphone for the manual mode of operation. The drive wheels 71 can be driven in a forward or reverse direction to move the unit forwardly or rearwardly. Furthermore, the drive wheels 71 can be operated simultaneously at the same rotational speed for linear motion or independently at different rotational speeds to turn the robot 10 in a desired direction.

The robot 10 can include any number of motors useful for performing locomotion and cleaning. In one example, five dedicated motors can be provided to rotate each of two pads 61, the brushroll 41, and each of two drive wheels 71. In another example, one shared motor can rotate both the pads 61, a second motor can rotate the brushroll 41, and a third and fourth motor can rotate each drive wheel 71. In still another example, one shared motor can rotate the pads 61 and the brushroll 41, and a second and third motor can rotate each drive wheel 71.

In addition, a brush motor driver 43, pump motor driver 55, pad motor driver 63, and wheel motor driver 73 can be provided for controlling the brush motor 42, pump motor 54, pad motors 62, and wheel motors 72, respectively. The motor drivers 43, 55, 63, 73 can act as an interface between the controller 20 and their respective motors 42, 54, 62, 72. The motor drivers 43, 55, 63, 73 can also be an integrated circuit chip (IC). It is also contemplated that a single wheel motor driver 73 can control multiple wheel motors 72 simultaneously.

Turning to FIG. 2, the motor drivers 43, 55, 63, 73 (FIG. 1) can be electrically coupled to a battery management system 80 that includes a built-in rechargeable battery or removable battery pack 81. In one example, the battery pack 81 can include lithium ion batteries. Charging contacts for the battery pack 81 can be provided on an exterior surface of the robot 10. A docking station (not shown) can be provided with corresponding charging contacts that can mate to the charging contacts on the exterior surface of the robot 10. The battery pack 81 can be selectively removable from the robot 10 such that it can be plugged into mains voltage via a DC transformer for replenishment of electrical power, i.e. charging. When inserted into the robot 10, the removable battery pack 81 can be at least partially located outside the housing 12 (FIG. 3) or completely enclosed in a compartment within the housing 12, in non-limiting examples and depending upon the implementation.

The controller 20 is further operably coupled with a user interface (UI) 90 on the robot 10 for receiving inputs from a user. The user interface 90 can be used to select an operation cycle for the robot 10 or otherwise control the operation of the robot 10. The user interface 90 can have a display 91, such as an LED display, for providing visual notifications to the user. A display driver 92 can be provided for controlling the display 91, and acts as an interface between the controller 20 and the display 91. The display driver 92 may be an integrated circuit chip (IC). The robot 10 can further be provided with a speaker (not shown) for providing audible notifications to the user. The robot 10 can further be provided with one or more cameras or stereo cameras (not shown) for acquiring visible notifications from the user. In this way, the user can communicate instructions to the robot 10 by gestures. For example, the user can wave their hand in front of the camera to instruct the robot 10 to stop or move away. The user interface 90 can further have one or more switches 93 that are actuated by the user to provide input to the controller 20 to control the operation of various components of the robot 10. A switch driver 94 can be provided for controlling the switch 93, and acts as an interface between the controller 20 and the switch 93.

The controller 20 can further be operably coupled with various sensors for receiving input about the environment and can use the sensor input to control the operation of the robot 10. The sensors can detect features of the surrounding environment of the robot 10 including, but not limited to, walls, floors, chair legs, table legs, footstools, pets, consumers, and other obstacles. The sensor input can further be stored in the memory or used to develop maps for navigation. Some exemplary sensors are illustrated in FIG. 2, and described below. Although it is understood that not all sensors shown may be provided, additional sensors may be provided, and that all of the possible sensors can be provided in any combination.

The robot 10 can include a positioning or localization system 100. The localization system 100 can include one or more sensor, including but not limited to the sensors described above. In one non-limiting example, the localization system 100 can include obstacle sensors 101 determining the position of the robot 10, such as a stereo camera in a non-limiting example, for distance and position sensing. The obstacle sensors 101 can be mounted to the housing 12 (FIG. 3) of the robot 10, such as in the front of the housing 12 to determine the distance to obstacles in front of the robot 10. Input from the obstacle sensors 101 can be used to slow down or adjust the course of the robot 10 when objects are detected.

Figure 3:
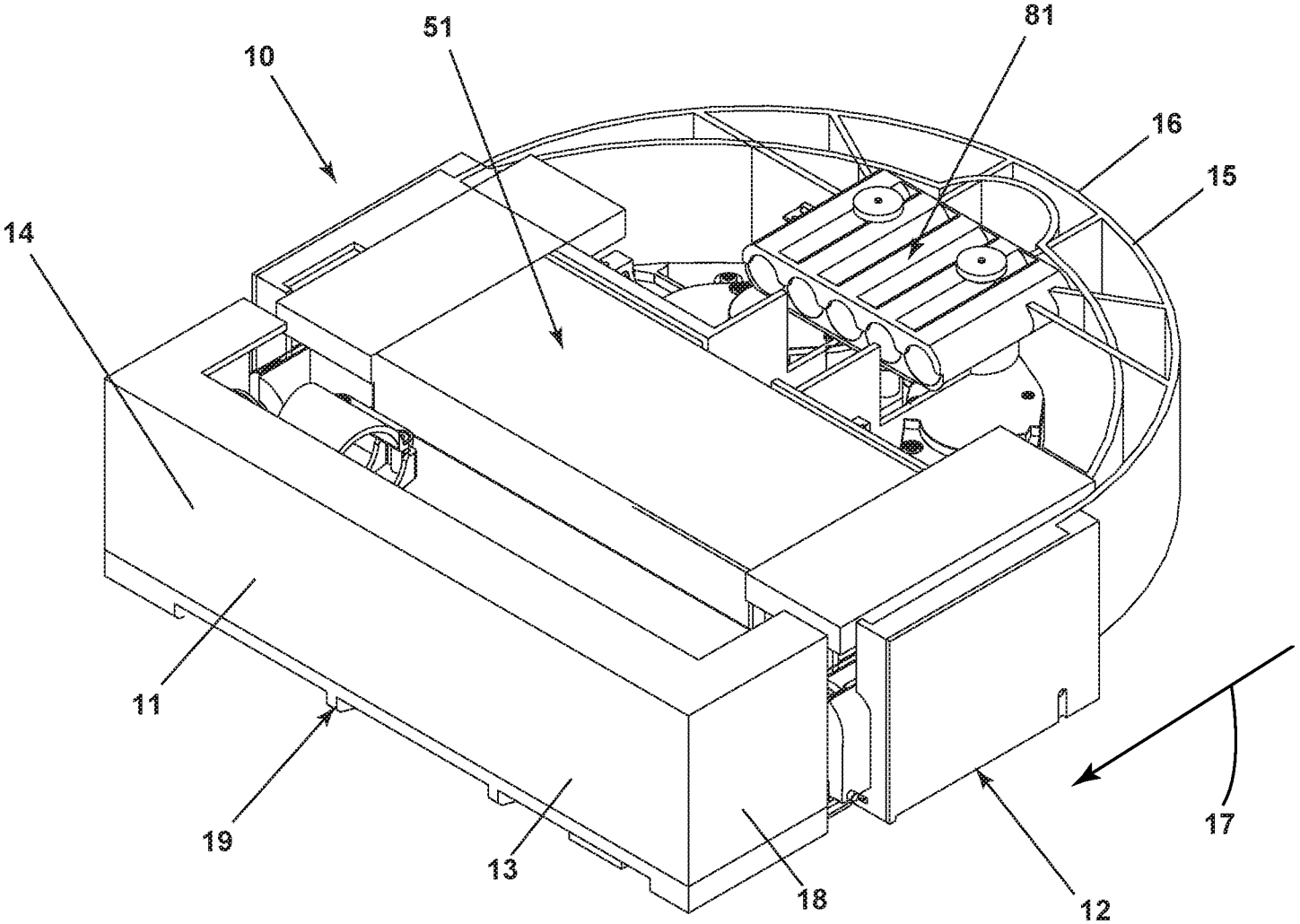
FIG. 3 is an isometric view of the autonomous floor cleaner of FIG. 1 in the form of a floor cleaning robot in accordance with various aspects described herein.

Bump sensors 102 can also be provided in the localization system 100 for determining front or side impacts to the robot 10. The bump sensors 102 may be integrated with the housing 12, such as with a bumper 14 (FIG. 3). Output signals from the bump sensors 102 provide inputs to the controller for selecting an obstacle avoidance algorithm.

The localization system 100 can further include a side wall sensor 103 (also known as a wall following sensor) and a cliff sensor 104. The side wall sensor 103 or cliff sensor 104 can be optical, mechanical, or ultrasonic sensors, including reflective or time-of-flight sensors. The side wall sensor 103 can be located near the side of the housing 12 and can include a side-facing optical position sensor that provides distance feedback and controls the robot 10 so that robot 10 can follow near a wall without contacting the wall. The cliff sensors 104 can be bottom-facing optical position sensors that provide distance feedback and control the robot 10 so that the robot 10 can avoid excessive drops such as stairwells or ledges.

The localization system 100 can also include an inertial measurement unit (IMU) 105 to measure and report the robot's acceleration, angular rate, or magnetic field surrounding the robot 10, using a combination of at least one accelerometer, gyroscope, and, optionally, magnetometer or compass. The inertial measurement unit 105 can be an integrated inertial sensor located on the controller 20 and can be a nine-axis gyroscope or accelerometer to sense linear, rotational or magnetic field acceleration. The IMU 105 can use acceleration input data to calculate and communicate change in velocity and pose to the controller for navigating the robot 10 around the surface to be cleaned.

The localization system 100 can further include one or more lift-up sensors 106 which detect when the robot 10 is lifted off the surface to be cleaned e.g. if a user picks up the robot 10. This information is provided as an input to the controller 20, which can halt operation of the pump motor 54, brush motor 42, pad motor 62, or wheel motors 73 in response to a detected lift-up event. The lift-up sensors 106 may also detect when the robot 10 is in contact with the surface to be cleaned, such as when the user places the robot 10 back on the ground. Upon such input, the controller 20 may resume operation of the pump motor 54, brush motor 42, pad motor 62, or wheel motors 73.

The robot 10 can optionally include one or more tank sensors 110 for detecting a characteristic or status of the supply tank 51 or the debris receptacle 44. In one example, one or more pressure sensors for detecting the weight of the supply tank 51 or the debris receptacle 44 can be provided. In another example, one or more magnetic sensors for detecting the presence of the supply tank 51 or debris receptacle 44 can be provided. This information is provided as an input to the controller 20, which may prevent operation of the robot 10 until the supply tank 51 is filled, the debris receptacle 44 is emptied, or both are properly installed, in non-limiting examples. The controller 20 may also direct the display 91 to provide a notification to the user that either or both of the supply tank 51 and debris receptacle 44 is missing.

The robot 10 can further include one or more floor condition sensors 111 for detecting a condition of the surface to be cleaned. For example, the robot 10 can be provided with an IR dirt sensor, a stain sensor, an odor sensor, or a wet mess sensor. The floor condition sensors 111 provide input to the controller that may direct operation of the robot 10 based on the condition of the surface to be cleaned, such as by selecting or modifying a cleaning cycle. Optionally, the floor condition sensors 111 can also provide input for display on a smartphone.

An artificial barrier system 120 can also be provided for containing the robot 10 within a user-determined boundary. The artificial barrier system 120 can include an artificial barrier generator 121 that comprises a barrier housing with at least one signal receiver for receiving a signal from the robot 10 and at least one IR transmitter for emitting an encoded IR beam towards a predetermined direction for a predetermined period of time. The artificial barrier generator 121 can be battery-powered by rechargeable or non-rechargeable batteries or directly plugged in to mains power. In one non-limiting example, the receiver can comprise a microphone configured to sense a predetermined threshold sound level, which corresponds with the sound level emitted by the robot 10 when it is within a predetermined distance away from the artificial barrier generator. Optionally, the artificial barrier generator 121 can further comprise a plurality of IR emitters near the base of the barrier housing configured to emit a plurality of short field IR beams around the base of the barrier housing. The artificial barrier generator 121 can be configured to selectively emit one or more IR beams for a predetermined period of time, but only after the microphone senses the threshold sound level, which indicates the robot 10 is nearby. Thus, the artificial barrier generator 121 can conserve power by emitting IR beams only when the robot 10 is near the artificial barrier generator 121.

The robot 10 can have a plurality of IR transceivers (also referred to as "IR XCVRs") 123 around the perimeter of the robot 10 to sense the IR signals emitted from the artificial barrier generator 121 and output corresponding signals to the controller 20, which can adjust drive wheel control parameters to adjust the position of the robot 10 to avoid boundaries established by the artificial barrier encoded IR beam and the short field IR beams. Based on the received IR signals, the controller 20 prevents the robot 10 from crossing an artificial barrier 122 or colliding with the barrier housing. The IR transceivers 123 can also be used to guide the robot 10 toward the docking station, if provided.

In operation, sound (or light) emitted from the robot 10 greater than a predetermined threshold signal level is sensed by the microphone (or photodetector) and triggers the artificial barrier generator 121 to emit one or more encoded IR beams for a predetermined period of time. The IR transceivers 123 on the robot 10 sense the IR beams and output signals to the controller 20, which then manipulates the drive system 70 to adjust the position of the robot 10 to avoid the barriers 122 established by the artificial barrier system 120 while continuing to perform a cleaning operation on the surface to be cleaned.

The robot 10 can operate in one of a set of modes. The modes can include a wet mode, a dry mode and a sanitization mode. During a wet mode of operation, liquid from the supply tank 51 is applied to the floor surface and both the brushroll 41 and the pads 61 are rotated. During a dry mode of operation, the brushroll 41, the pads 61, or a combination thereof, are rotated and no liquid is applied to the floor surface. During a sanitizing mode of operation, liquid from the supply tank 51 is applied to the floor surface and both the brushroll 41 and the pads 61 are rotated and the robot 10 can select a travel pattern such that the applied liquid remains on the surface of the floor for a predetermined length of time. The predetermined length of time can be any duration that will result in sanitizing floor surfaces including, but not limited to, two to five minutes. However, sanitizing can be effected with durations of less than two minutes and as low as fifteen seconds.

It is also contemplated that the pump 53 (FIG. 1) can be driven according to a pulse-width modulation (PWM) signal 28. Pulse-width modulation is a method of communication by generating a pulsing signal. Pulse-width modulation can be utilized for controlling the amplitude of digital signals in order to control devices and applications requiring power or electricity, such as the pump motor 54. The PWM signal 28 can control an amount of power given to the pump 53 by cycling the on-and-off phases of a digital signal at a predetermined frequency and by varying the width of an "on" phase. The width of the "on" phase is also known as duty cycle, which is expressed as the percentage of being "fully on" (100%). The pump 53 can essentially receive a steady power input with an average voltage value which is the result of the duty cycle and can be less than the maximum voltage capable of being delivered from the battery pack 81. The PWM signal 28 can be transmitted from the controller 20 and configured to provide a set flowrate of deposited cleaning fluid. The pump 53 can be driven by pump motor 54 to move liquid at any flowrate useful for a cleaning cycle of operation, including, but not limited to a range of flowrates from 2 to 30 milliliters per second. In one non-limiting example of operation, the PWM signal 28 can cyclically energize the pump 53 for a first predetermined time duration, such as 40 milliseconds, and then de-energize the pump for a second predetermined time duration, such as 2 seconds, at a rate of 50 Hz and a duty cycle of 50%. Higher flow rates can be achieved by, for example, increasing either of both of the duty cycle or frequency. In this manner, the controller 20 can provide for any suitable or customized flow rate, including a low flow rate, from the pump 53 being powered from the battery pack 81.

FIG. 3 illustrates the exemplary robot 10 that can include the systems and functions described in FIGS. 1-2. As shown, the robot 10 can include a D-shaped housing 12 with a first end 13 and a second end 15. The first end 13 defines a housing front 11 of the robot 10 and can be formed by the bumper 14. The second end 15 can define a housing rear 16 which is a straight-edge portion of the D-shaped housing 12. The battery pack 81 and supply tank 51 can also be mounted to the housing 12 as shown.

Forward motion of the robot 10 is illustrated with an arrow 17, and the bumper 14 wraps around the first end 13 of the robot 10 to provide a lateral portion 18 along the D-shaped front region of the robot 10. In the illustrated example, the bumper 14 includes a lower crenellated structure 19 which is described in more detail below. During a collision with an obstacle, the bumper 14 can shift or translate to register a detection of an object.

Figure 4:
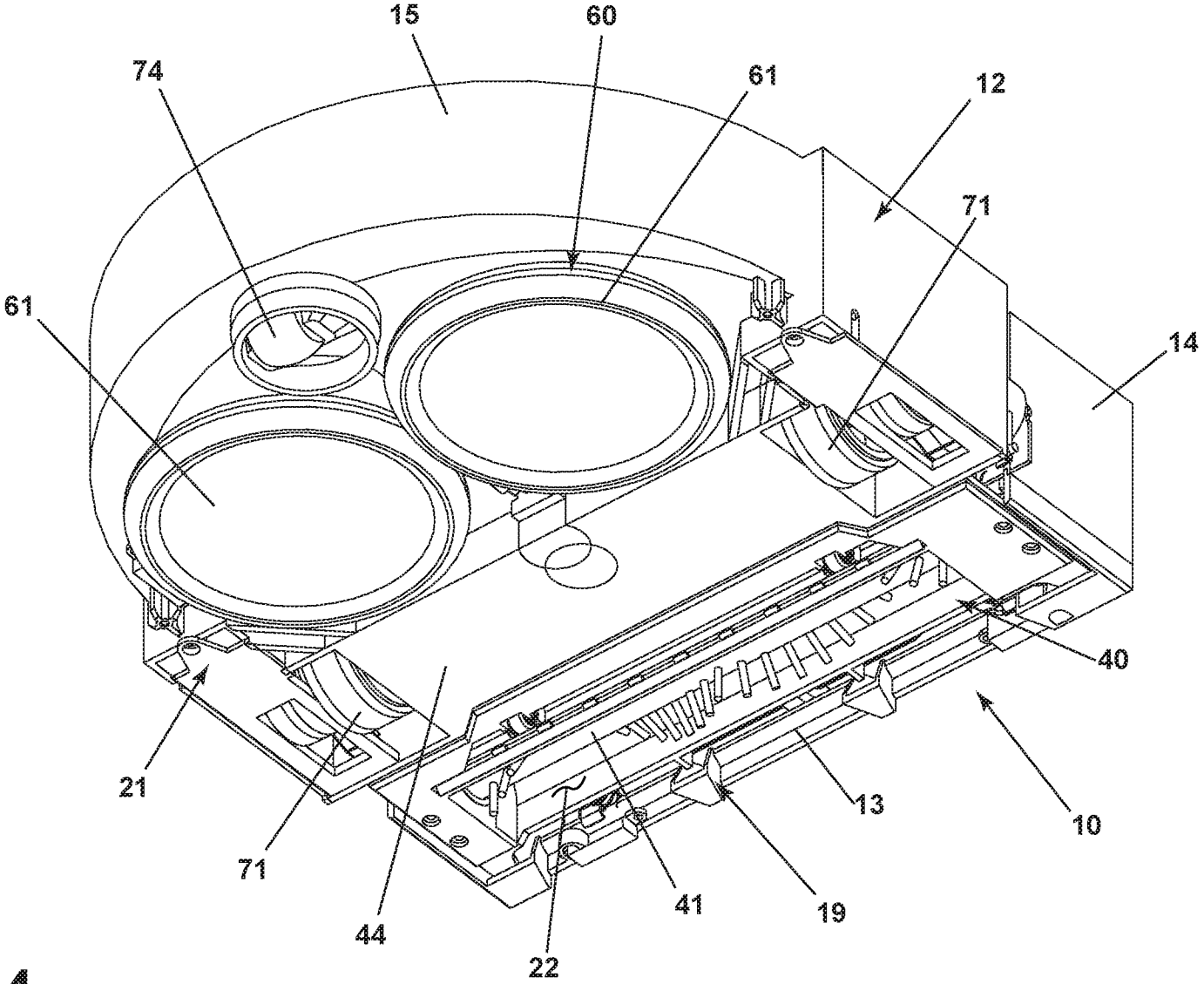
FIG. 4 is an isometric view of the underside of the floor cleaning robot of FIG. 3.

The robot 10 is shown in a lower perspective in FIG. 4, where an underside portion 21 of the housing 12 is visible. The robot 10 can include the sweeper 40 with brushroll 41, at least one wheel assembly with a drive wheel 71, and the dusting assembly 60 which is illustrated with two circular pads 61. The brushroll 41 can be positioned within a brush chamber 22. The brushroll 41 and brush chamber 22 can be located proximate the second end 15, e.g. proximate the straight-edge portion of the housing 12. Along the bottom surface of the robot 10 and with respect to forward motion of the robot 10, the sweeper 40 is mounted ahead of the pads 61 and drive wheels 71 are disposed therebetween. In addition, the debris receptacle 44 can be positioned adjacent the brushroll 41 and brush chamber 22. In the illustrated example, the debris receptacle 44 is positioned in line with the drive wheels 71, between the brush chamber 22 and pads 61. It is also contemplated that the first end 13 of the D-shaped housing can include a straight-edge portion as well as a nonlinear portion, such as a curved, bumped, or ribbed portion in non-limiting examples.

The robot 10 can also include one or more casters 74 set behind the brush chamber 22. The casters 74 can include a wheel mounted on an axle, or an omnidirectional ball for rolling in multiple directions, in non-limiting examples. The one or more casters 74 can, in one example, be utilized to maintain a minimum spacing between the surface to be cleaned and the underside portion 21 of the robot 10.

In another example (not shown), a squeegee can optionally be provided on the housing 12, such as behind the pads 61. In such a case, the squeegee can be configured to contact the surface as the robot 10 moves across the surface to be cleaned. The squeegee can wipe any remaining residual liquid from the surface to be cleaned, thereby leaving a moisture and streak-free finish on the surface to be cleaned. In a dry application, the squeegee can prevent loose debris from being propelled by the brushroll 41 to the rear of the robot 10.

Figure 5:
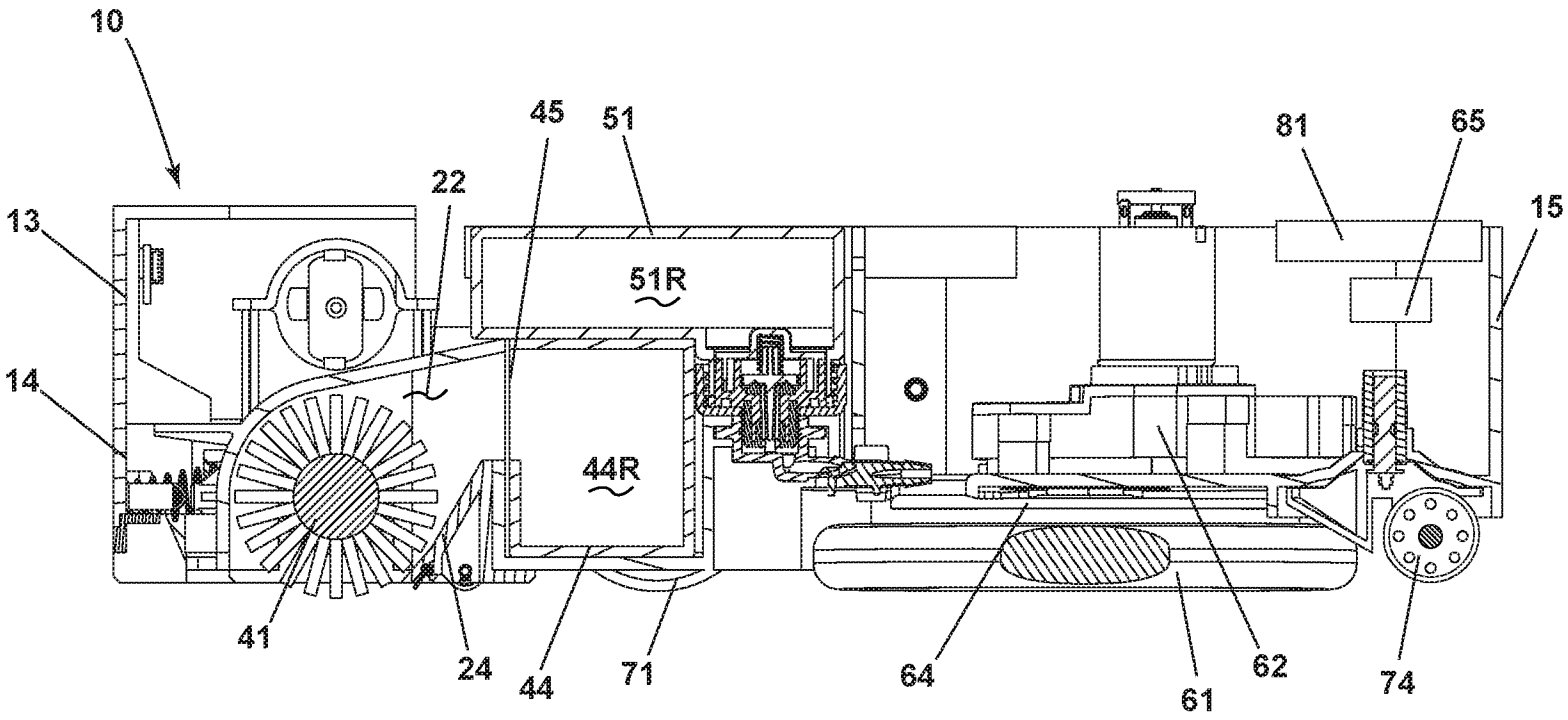
FIG. 5 is a side elevation cross-sectional view of the floor cleaning robot of FIG. 3.

FIG. 5 is a side elevation cross-sectional view of the robot 10. The supply tank 51 and debris receptacle 44 can be separate components within the robot 10. Alternately, the supply tank 51 and debris receptacle 44 can be integrated into a single tank assembly.

The supply tank 51 can define at least one supply reservoir 51R to store liquid for application, via the pump 53 (FIG. 1), to a surface of a floor to be cleaned by the dusting assembly 60. The debris receptacle 44 define at least one receptacle reservoir 44R and can include a receptacle inlet 45 directly adjacent, and open to, the brush chamber 22. The brush chamber 22 can include a partition having a ramped front surface 24 provided at a bottom of the receptacle inlet 45 to guide debris into the debris receptacle 44. In operation, dirt or debris swept up by rotation of the brushroll 41 can be moved by the brushroll 41 through the brush chamber 22, including along the ramped front surface 24, and propelled through the receptacle inlet 45 into the debris receptacle 44.

Optionally, pad holders 64 can be utilized to mount the circular pads 61 to the housing 12. In such a case, the pad holders 64 can include rotation plates and form the bottom of the base of the dusting assembly 60. The pad holders 64 can include a bottom cover through which a motor shaft of the pad motor 62 extends. The pad motor 62 rotates the motor shaft via a suitable transmission, such as a worm gear assembly that can rotate the pad holder 64 and, consequently, the pad 61. The coupling between the motor shaft and the rotatably driven pad holder 64 defines a vertical axis of rotation for the pad 61.

To remove the pads 61 for cleaning, the dusting assembly 60 can include selectively removable elements. In one non-limiting example, the selectively removable elements can be the pads 61, and in such a case a consumer can remove the pads 61 for cleaning or replacement. In another non-limiting example, the removable elements include detachable elements such as the pad holder 64 which couple the pads 61 to the pad motor 62. In such a case, a consumer can release the removable elements (e.g. the pad holders 64) through any suitable decoupling means and can then remove the pads 61 from the removable elements for cleaning or replacement. In one example, the removable elements are released from the robot 10 via an actuator 65 directly coupled to a mechanical catch and latch assembly. It is also contemplated that the pad holders 64 can also be rotatable along with the pads 61 in the dusting assembly 60.

Alternatively, or in addition to the selectively removable elements, a cleaning station (not shown) can be provided to aid in cleaning or replacing the pads of the dusting assembly 60. The robot 10 can be placed on the cleaning station and can apply or assist in a cleaning operation for the pads. In one example, the cleaning station can include a surface provided with a plurality of bosses or nubs for agitating the bottom of the pads 61. The robot 10 can activate a self-cleaning mode where the pads 61 are rotated while in contact with the plurality of bosses or nubs to produce an agitation process that mechanically cleans the pads 61.

Figure 6:
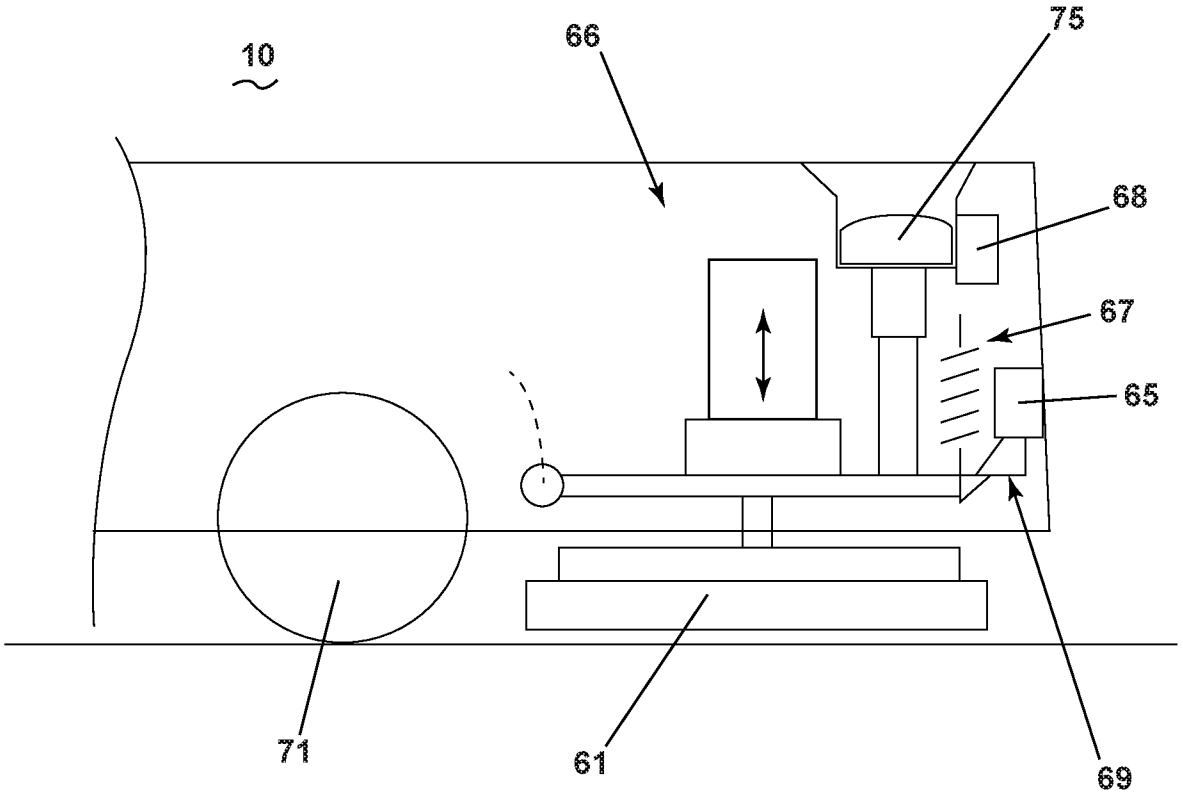
FIG. 6 is a schematic illustration of a dusting assembly of the cleaning robot of FIG. 3.

FIG. 6 illustrates additional details of the dusting assembly 60. The robot 10 can optionally include a pad-lifting assembly 66 that selectively and automatically lifts the pads 61 off the floor surface whenever the robot 10 comes to a complete stop. In the illustrated example, the dusting assembly 60 including the rotating pads 61 are coupled to a movable frame that includes a spring 67 which is biased to provide vertical separation between the pads 61 and the floor surface. A user can initiate a cleaning cycle of operation, for example, by pressing a button 75 that activates a micro-switch 68 and displaces the dusting assembly 60 from a raised position, with the pads 61 out of contact with the floor surface, downwardly to a lowered position in which the pads 61 contact the floor surface. The dusting assembly 60 can be selectively retained in the lowered position by a catch 69 that is selectively movable by another actuator 65 such as a solenoid. The robot 10 can be configured to activate the actuator 65 to move the catch 69 and release the dusting assembly 60 after a cleaning cycle of operation such that the spring 67 urges the dusting assembly 60 to translate back to the raised position. In this manner, the pads 61 can be out of contact with the floor surface while drying, thus preventing streaking and staining of the floor surface directly beneath the pads 61.

In another example (not shown), the pad-lifting assembly 66 can include a caster 74 coupled to an actuator, such as a solenoid, configured to affect a linear motion that extends the caster 74 downward from a first raised position to a second lowered position. The caster 74 can travel downward to contact the surface of the floor and at which point it raises at least a rear portion of the robot 10 until the pads 61 are no longer in contact with the floor surface. In another example, the robot 10 can selectively engage the pad-lifting assembly 66 to raise the pads 61 off the floor surface at the completion of a scheduled cleaning cycle of operation.

In still another example (not shown), the robot 10 can vary the speed and direction of the rotation of the pads. The robot 10 can select the speed and rotation according to a cycle of operation to aid or improve cleaning or locomotion of the robot 10. In one example, the pads can counter-rotate such that the front edge of each pad is spinning away from the spray nozzle. The rate of spinning can include any rate useful for performing a cleaning cycle of operation including, but not limited to a range of rotations per minute from 80 to 120. However, slower and faster rotations may be advantageous for specialized cleaning modes.

Figure 7:
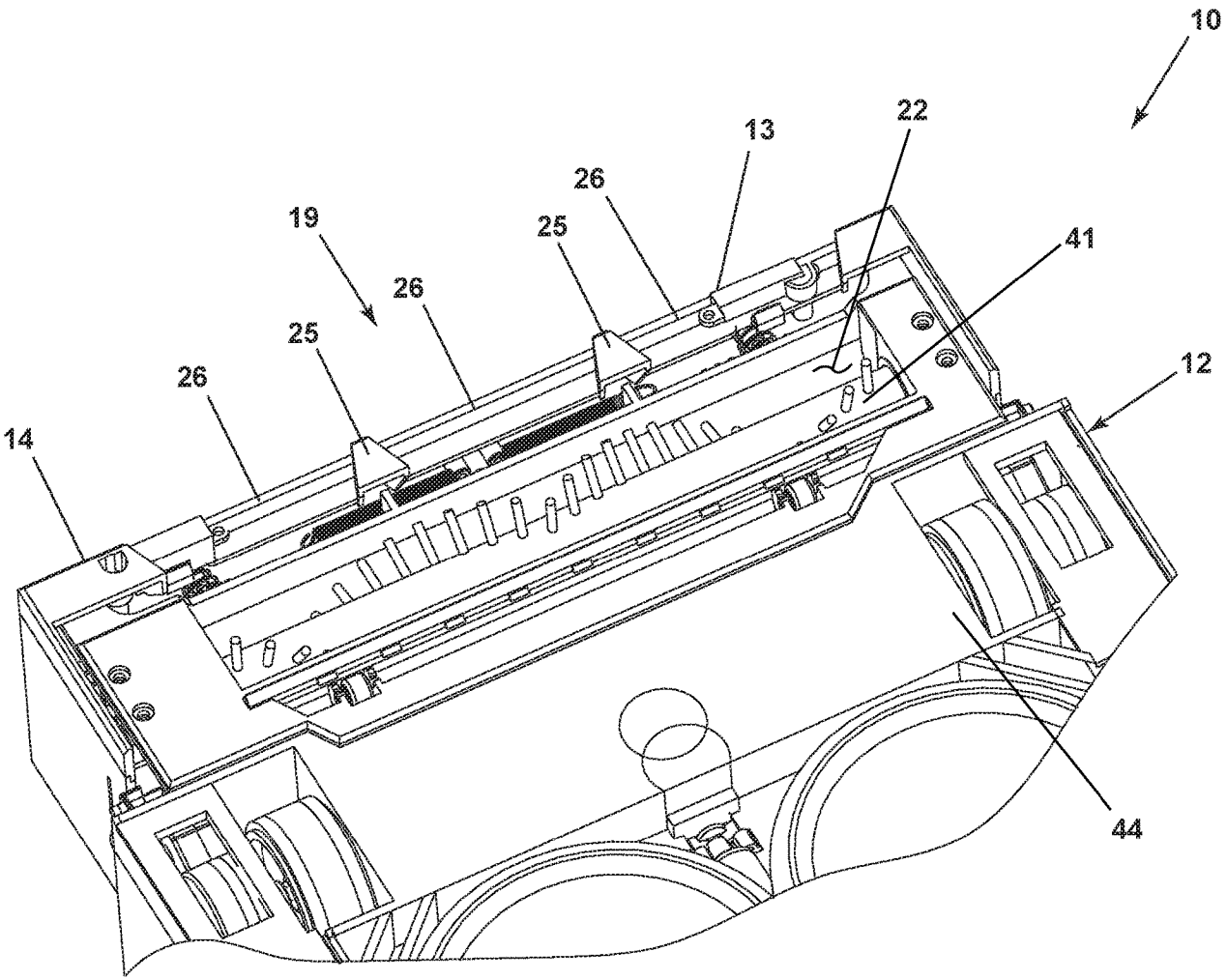
FIG. 7 is an isometric view of the underside of the floor cleaning robot of FIG. 3 illustrating a bumper assembly.

FIG. 7 illustrates the underside of the robot 10 with the bumper 14 shown in additional detail. A lower portion of the bumper 14 can include a crenellated structure 19 of interleaved merlons 25 and crenels 26. In other words, the lower portion of the bumper 14 has a series of projecting lead-ins (merlons 25) that direct debris into the openings (crenels 26) disposed along the lower leading edge of the bumper 14 between adjacent merlons 25. Such a configuration allows the robot 10 to detect surface transitions, such as from a hard surface to an area rug or carpet, through sensors on the forward bumper 14 while also allowing debris to pass through the crenels 26. The merlons 25 can be formed of a substantially trapezoidal cross-section where the shorter base of the trapezoid forms the leading edge of the bumper 14 with respect to the forward motion of the robot 10. In this way, debris can be funneled along the legs of the trapezoidal merlons 25 to the sweeper 40 (e.g. the brushroll 41 and brush chamber 22) configured behind the bumper 14. In another example (not shown), the debris receptacle 44 can include a flapper to prevent the collected debris from inadvertently spilling out of the debris receptacle during removal or transport to a waste container.

Figure 8:
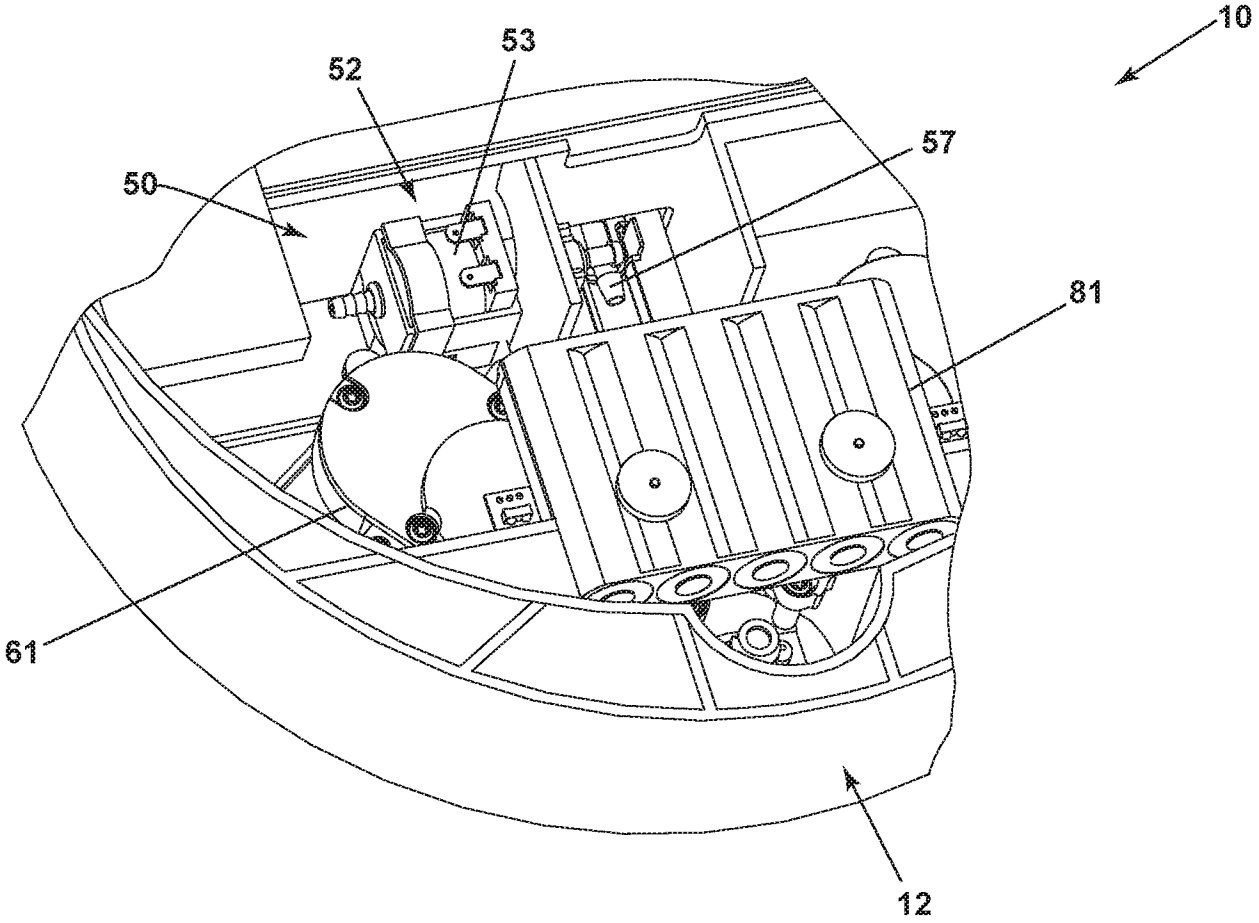
FIG. 8 is an isometric view of the floor cleaning robot of FIG. 3 illustrating a fluid spray nozzle.

FIG. 8 is an isometric view of the robot 10 illustrating further details of the fluid delivery system 50. In the example shown, the distributor 52 includes a spray nozzle 57 fluidly coupled to the supply tank 51 (FIG. 3) via the pump 53. The spray nozzle 57 can be positioned between adjacent pads 61 as shown. In one example, cleaning fluid dispensed from the spray nozzle 57 can be delivered directly to the floor surface, and the rotating pads 61 can absorb and remove the applied cleaning fluid from the floor surface, including during a wet mode of operation of the robot 10 as described above.

Figure 9:
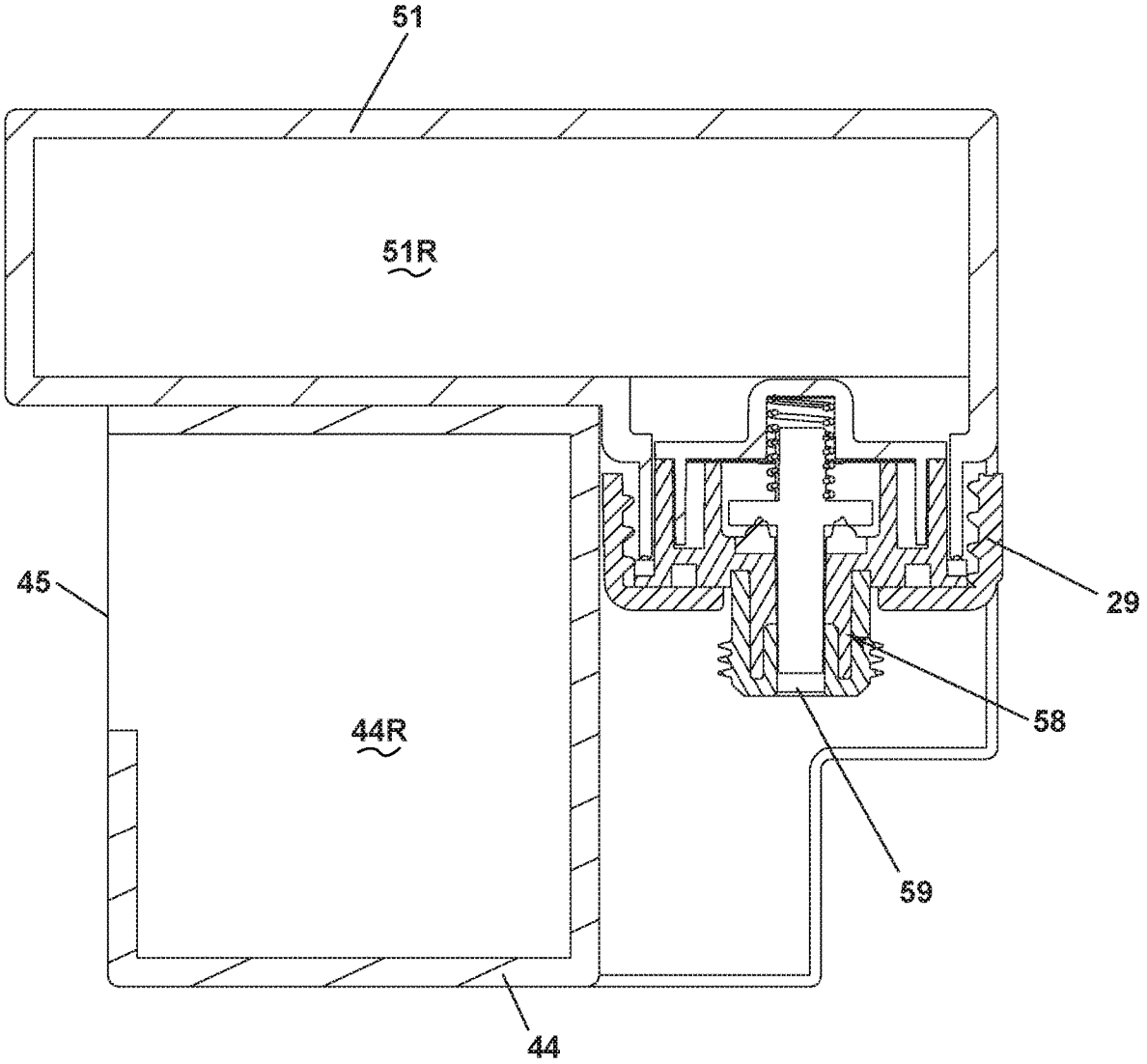
FIG. 9 is a cross-sectional view of a tank assembly in the floor cleaning robot of FIG. 3.

A cross-sectional view of the debris receptacle 44 and supply tank 51 are shown in FIG. 9. The supply tank 51 can further include a valve 58 with an outlet 59 that is fluidly connected to a downstream portion of the fluid delivery system, such as the spray nozzle 57 (FIG. 8). In one example, the valve 58 can comprise a plunger valve removably mounted to an open neck on bottom of the supply tank 51. A mechanical closure 29, such as a threaded cap, can secure the valve to the supply tank 51 and be easily removed for refilling the supply tank 51 when necessary. In the example shown, the supply tank 51 includes a single supply reservoir 51R for water or a combination of water and a cleaning formula. In another example (not shown), the supply tank 51 can includes a first reservoir for storing water and a second reservoir for storing a cleaning formula. It is contemplated that the robot 10 can include multiple supply tanks, a single supply tank with multiple reservoirs or chambers therein, or the like, or combinations thereof for storing cleaning fluid within the robot 10.

Figure 10:
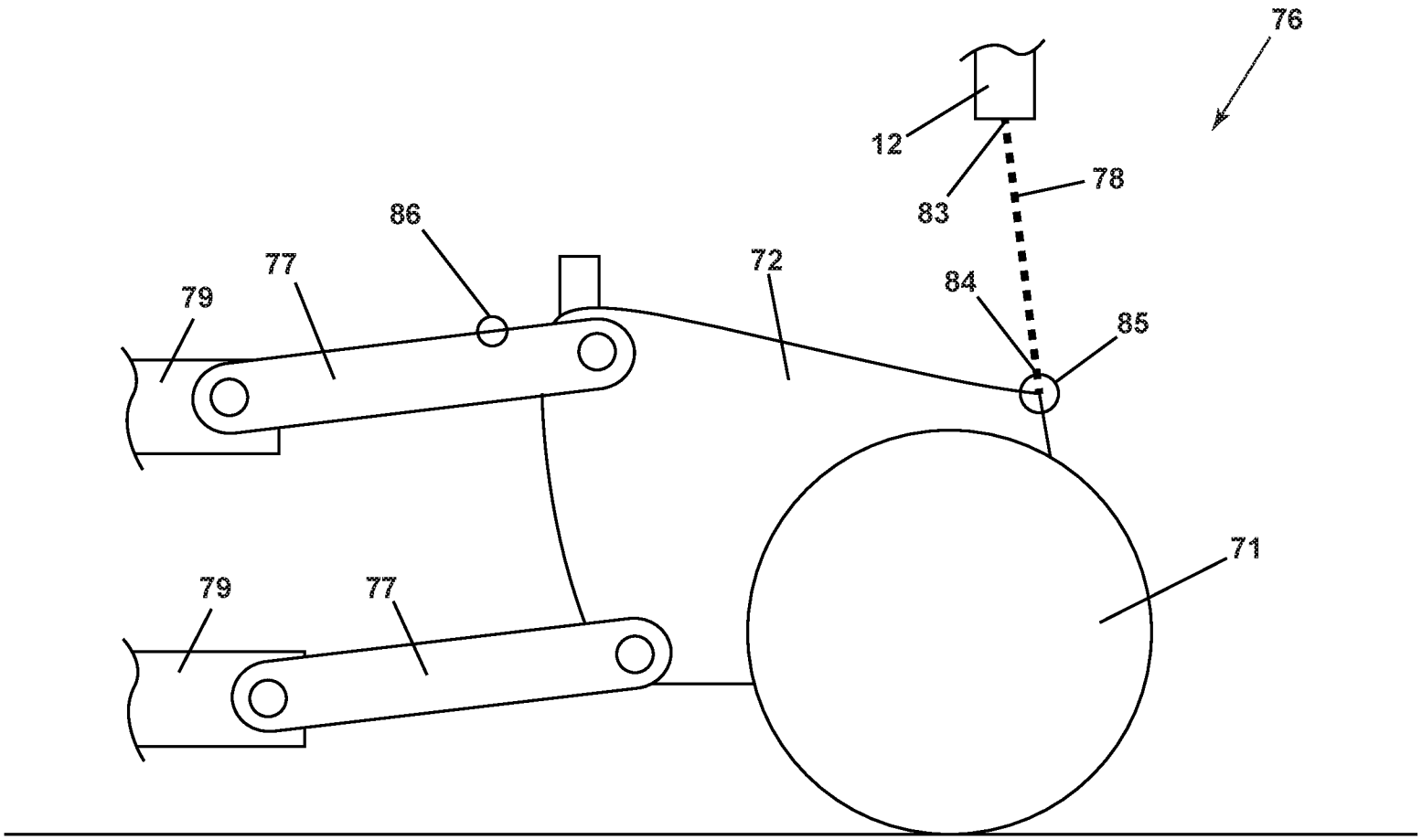
FIG. 10 is a schematic illustration of a wheel assembly that can be utilized in the floor cleaning robot of FIG. 1.

FIG. 10 is a schematic illustration of a wheel assembly 76 of the robot 10 having parallel linkages 77 and an extension spring 78. The wheel assembly 76 in the illustrated example includes one or more drive wheel subassemblies. A drive wheel subassembly includes at least one drive wheel 71 coupled to a wheel housing 79 via at least one linkage 77. The at least one linkage 77 can include any element useful for raising or lowering the wheel with respect to the wheel housing. The wheel housing 79 is coupled to the chassis or housing 12 of the robot 10. In addition, the extension spring 78 can include a first end 83 coupled to the housing 12 or a sensor thereon, such as the lift-up sensor 106 (FIG. 2). A second end 84 of the extension spring 78 can couple to any suitable portion of the robot 10, illustrated with an exemplary first position 85 on a housing of the wheel motor 72, or an exemplary second position 86 directly on the at least one linkage 77, in non-limiting examples.

During locomotion of the robot 10, if the drive wheels 71 traverse an obstacle such as a threshold or power cord, the linkages 77 can rotate while the drive wheels 71 can partially rise into the wheel housing 79, aided by the extension spring 78, such that the pads 61 remain in contact with the floor surface. During locomotion of the robot 10, if the drive wheels 71 lose contact with the floor surface, the drive wheels 71 can lower from the wheel housing 79 and indicate that the robot 10 has been lifted from the floor surface.

Figure 11:
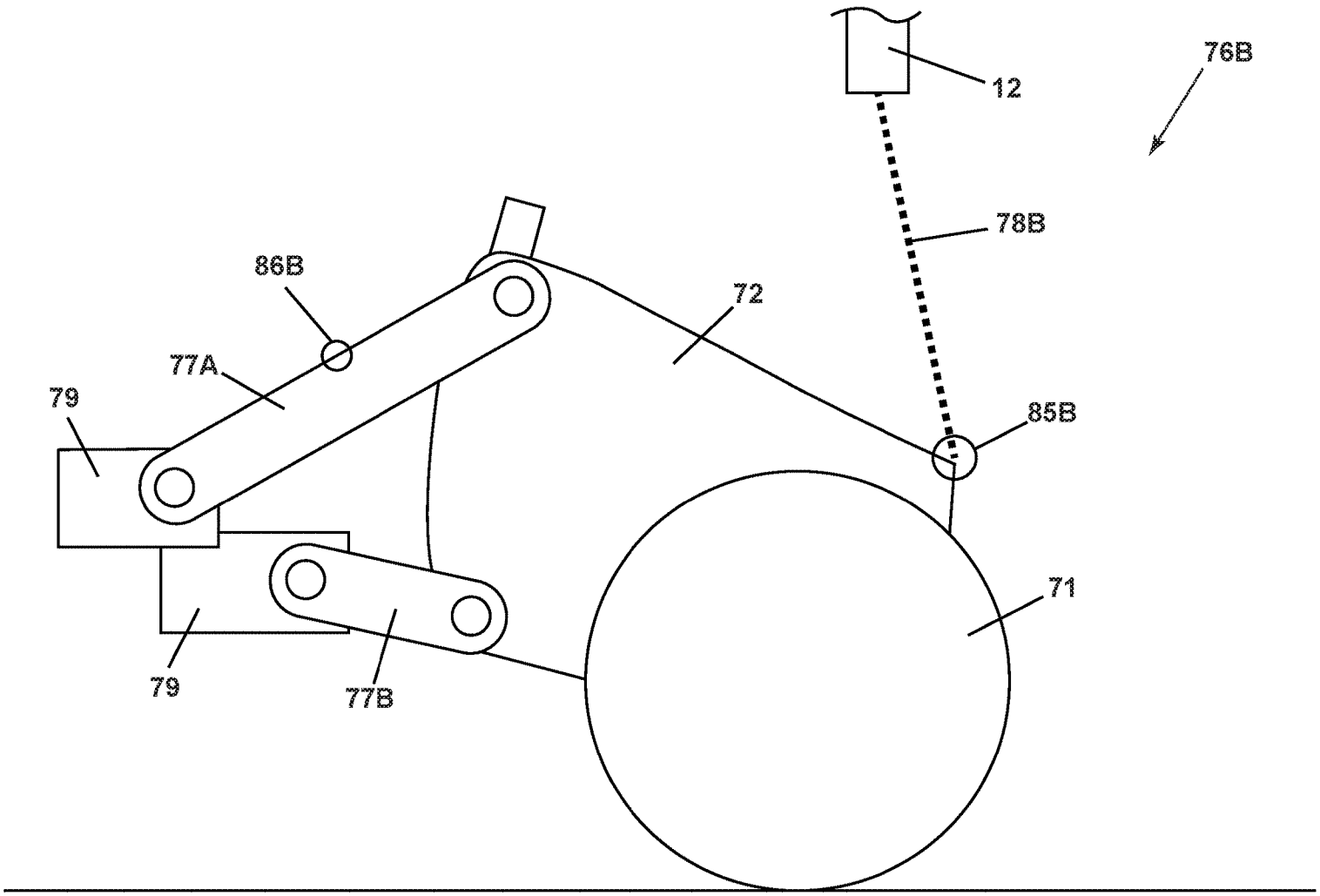
FIG. 11 is a schematic illustration of another wheel assembly that can be utilized in the floor cleaning robot of FIG. 1.

FIG. 11 is a schematic illustration of another wheel assembly 76B similar to the wheel assembly 76. One difference is that the wheel assembly 76B includes a compression spring 78B biasing the drive wheels 71 downward toward the surface to be cleaned. Another difference is that the wheel assembly 76B can include non-parallel first and second linkages 77A, 77B coupling the drive wheels 71 to the wheel housing 79. The non-parallel linkages 77A, 77B, can, in one example, be utilized in combination with the compression spring 78B to direct the drive wheels 71 in a customized direction or path of movement in the event of the robot 10 traversing an obstacle such as a flooring threshold or power cord. The compression spring 78B can be coupled at a first position 85B to the drive wheel 71, or directly to either of the non-parallel linkages 77A. 77B as illustrated with a second position 86B.

Figure 12:
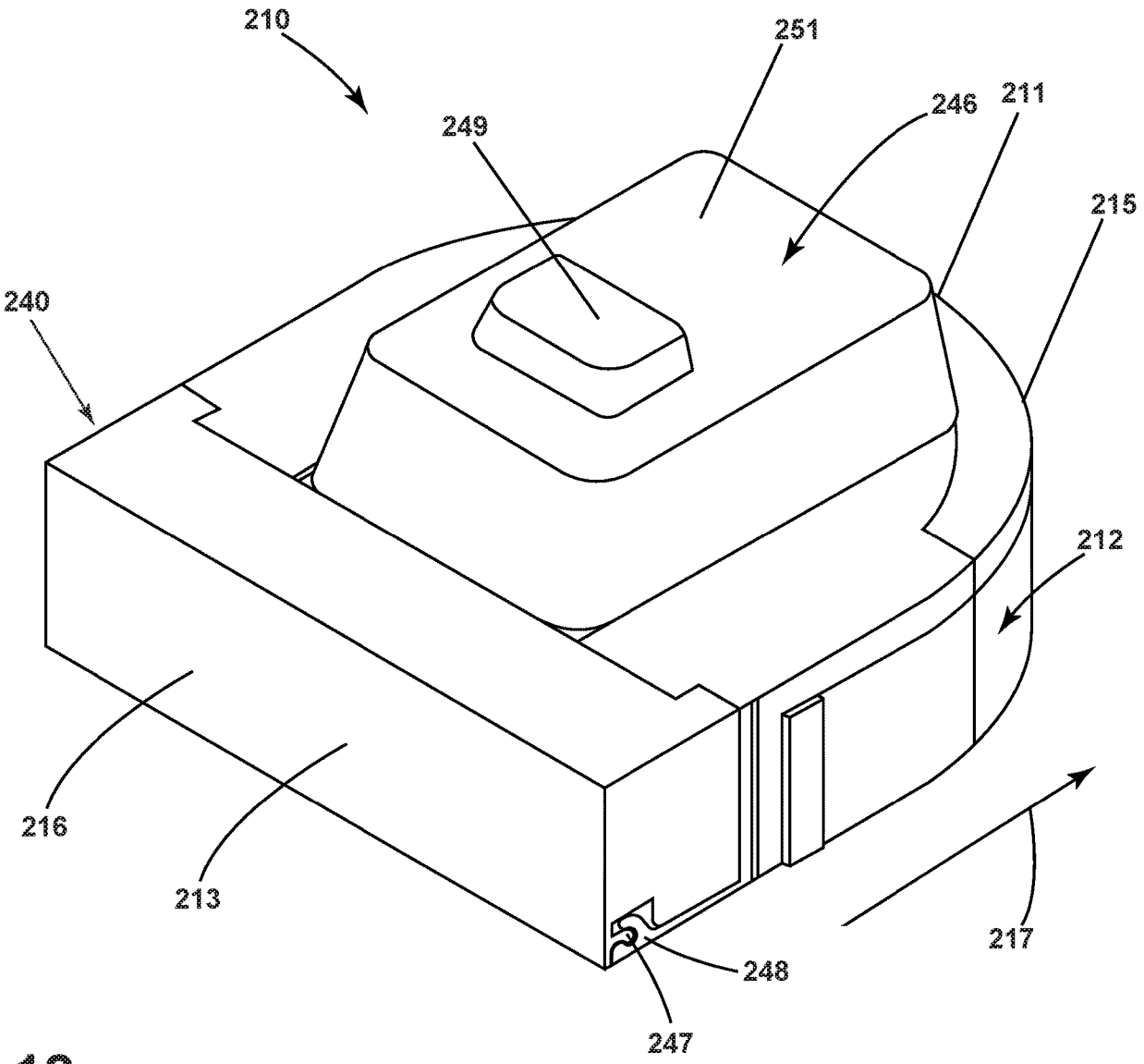
FIG. 12 is an isometric view of another floor cleaning robot in accordance with various aspects described herein.

Referring now to FIG. 12, another autonomous floor cleaner, such as another floor cleaning robot 210 is illustrated that can include the various functions and system as described in FIGS. 1-2. The robot 210 is similar to the robot 10; therefore, like parts will be identified with like numerals increased by 200, with it being understood that the description of the like parts of the robot 10 applies to the robot 210, except where noted.

The robot 210 can include the D-shaped main housing 212 adapted to selectively mount components of the systems to form a unitary movable device. One difference is that the robot 210 can include a sweeper 240 without including a dusting assembly as described above.

Another difference is that the robot 210 can be driven in an opposite direction as compared to the robot 10, where an arrow 217 illustrates a direction of motion of the robot 10 during operation. More specifically, a first end 213 forming a straight-edge portion of the D-shaped housing 212 can define the housing rear 216, and a second end 215 forming a rounded edge of the housing 212 can define the housing front 211.

Figure 13:
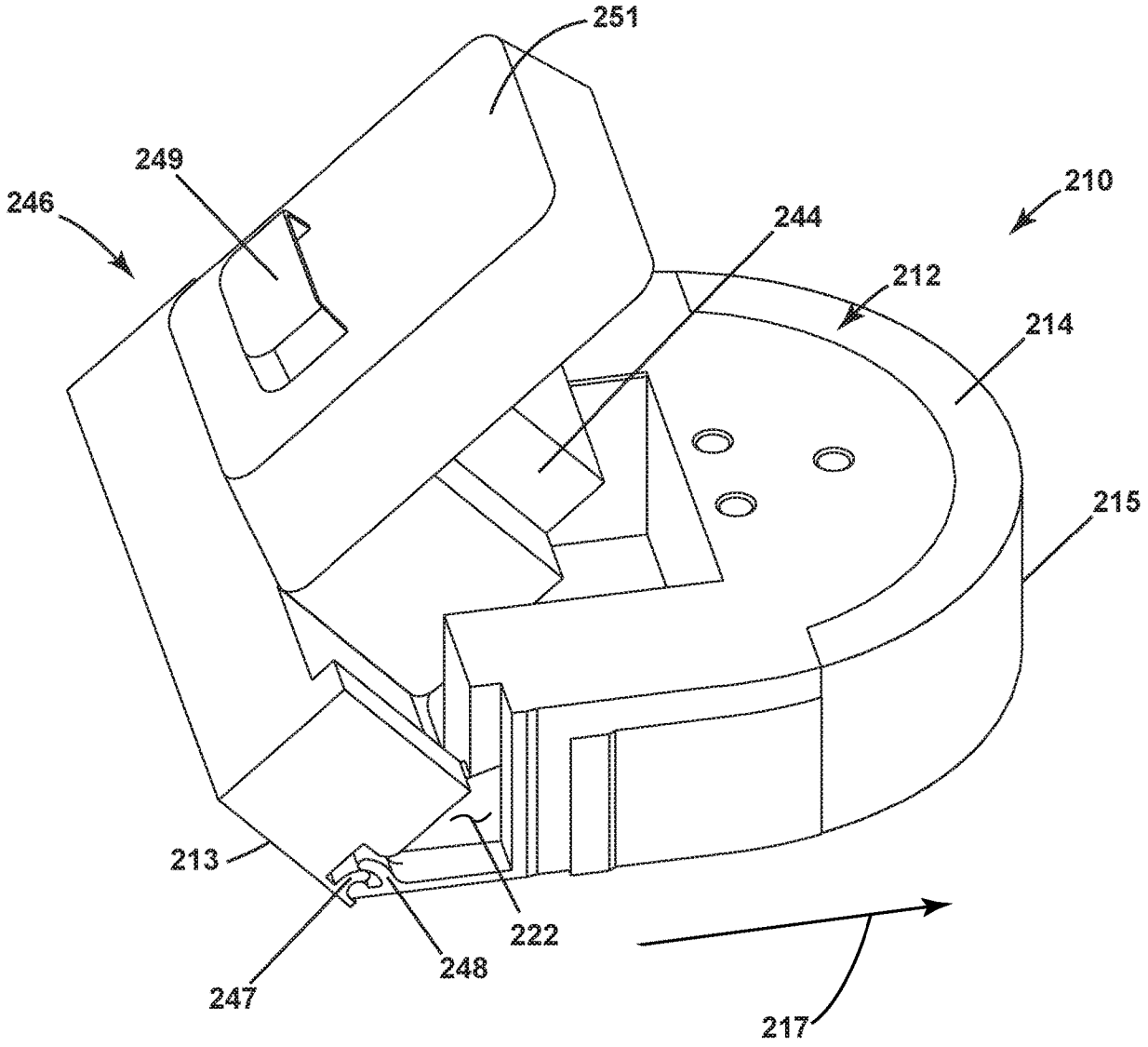
FIG. 13 is an isometric view of the floor cleaning robot of FIG. 12 illustrating a tank assembly.

Another difference is that the robot 210 can further include a unitary or integrated tank assembly 246. Turning to FIG. 13, the integrated tank assembly 246 can include a supply tank 251 and debris receptacle 244. The tank assembly 246 is shown in a partially-removed state from the housing 212. It is contemplated that the tank assembly 246 can be selectively removed by a consumer such that both the supply tank 251 and the debris receptacle 244 are removed together in one action. For example, the tank assembly 246 can include a hook-and-catch mechanism wherein a hook 247 on the tank assembly 246 engages with a catch 248 on the housing 212 of the robot 210. A handle 249 can be provided on the tank assembly 246, wherein a user can grasp the handle 249 and rotate the tank assembly 246 to disengage the tank assembly 246 from the housing 212.

It is further contemplated that the tank assembly 246 can at least partially define the brush chamber 222. The brushroll is not shown in this view for clarity; however, any suitable agitator including one or more brushrolls can be provided. The brush chamber 222 can be open to the debris receptacle 244 as described above. In the illustrated example, the brushroll (not shown) can be located at the rear of the housing 212 when the robot 210 moves in the direction indicated by the arrow 217. Optionally, a bumper 214 can form the second end 215 of the housing 212.

Figure 14:
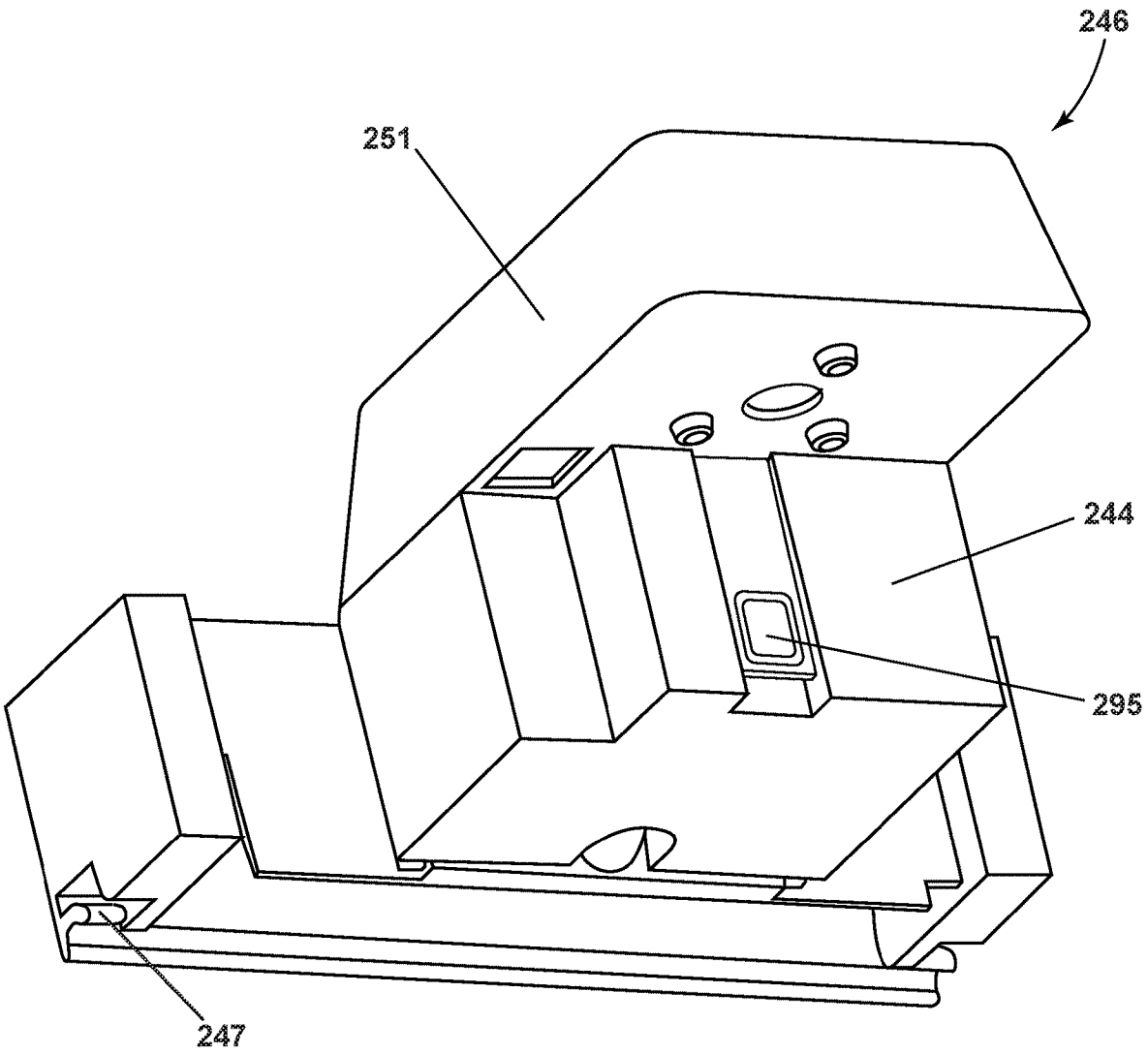
FIG. 14 is an isometric view of the tank assembly of FIG. 13 illustrating a fluid supply tank and a debris receptacle.

FIG. 14 illustrates the tank assembly 246 in isolation with the supply tank 251 and debris receptacle 244. The supply tank 251 can be positioned above the debris receptacle 244. It is further contemplated that the debris receptacle 244 can be selectively removable from the supply tank 251. Any suitable mechanism can be utilized, such as a second hook-and-catch mechanism (not shown) between the supply tank 251 and debris receptacle 244. A release button 295 or other actuator can optionally be provided for selective detachment of the debris receptacle 244 from the tank assembly 246.

Figure 15:
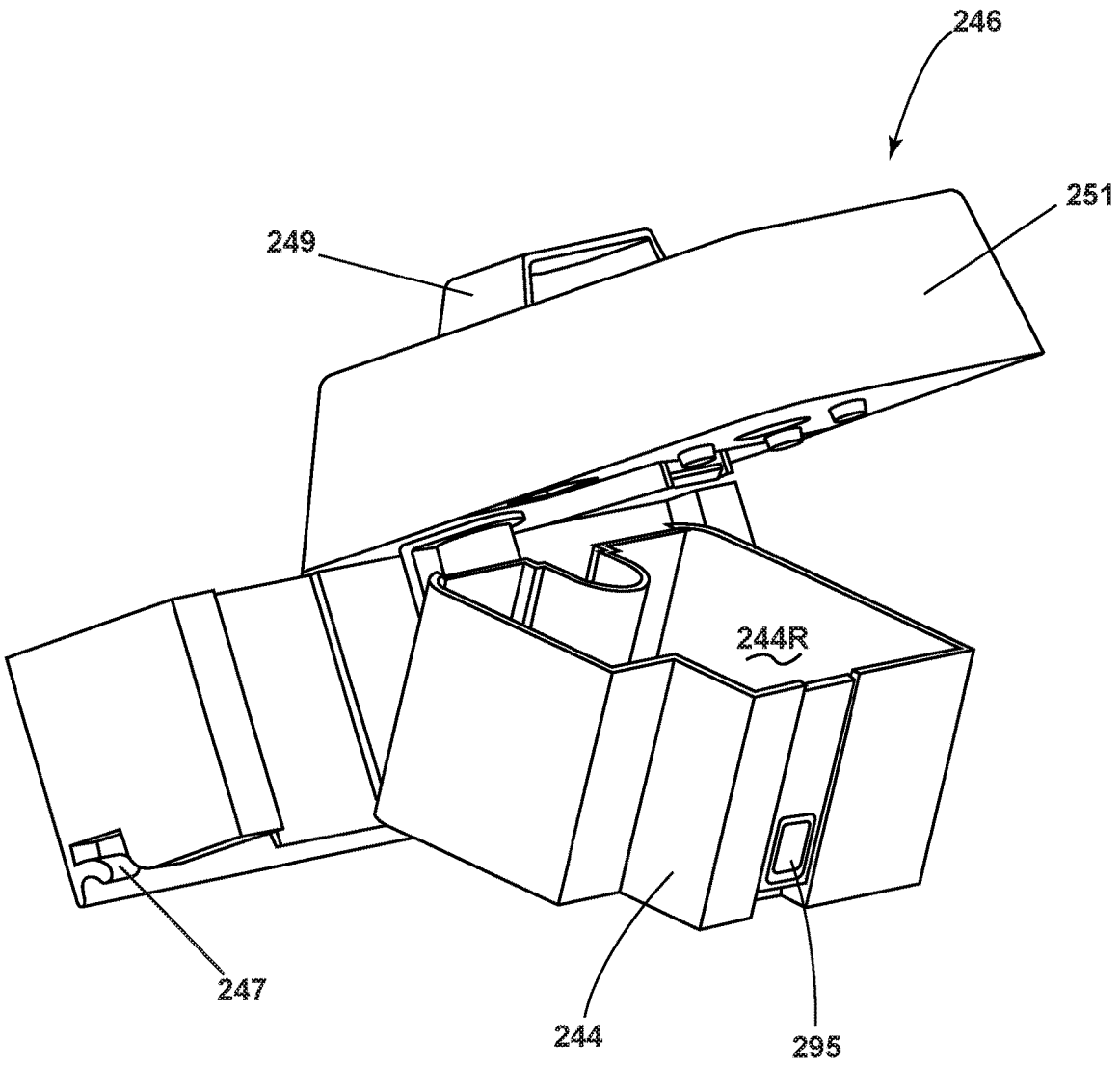
FIG. 15 is an isometric view of the tank assembly of FIG. 14 illustrating a coupling between the fluid supply tank and the debris receptacle.

FIG. 15 illustrates removal of the debris receptacle 244 from the supply tank 251. The debris receptacle 244 can be rotated downward and away from the supply tank 251 to access the receptacle reservoir 244R, such as for complete removal and cleanout of the receptacle 244. It can also be appreciated that removal of the supply tank 251 and debris receptacle 244 in a single integrated tank assembly 246 can improve usability, wherein a consumer can remove the tank assembly 246 in a single action to fill the supply tank 251 with cleaning fluid and remove debris from the receptacle 244.

There are several advantages of the present disclosure arising from the various aspects or features of the apparatus, systems, and methods described herein. For example, aspects described above provide an autonomous cleaning robot that sweeps and mops a floor surface in a single pass, including a single pass in a "forward" or "backward" direction. The present disclosure provides a single autonomous floor cleaner that sweeps directly in front of the dusting assembly. This eliminates the need for either two floor cleaning apparatus to completely clean or a single robot that cleans by multiple passes.

Another advantage of aspects of the disclosure relates to the consistency and robustness of the liquid distribution system. In contrast to prior art wicking pads, the disclosed pump and spray nozzle provide fluid at a consistent low flowrate that does not degrade over time. The low flowrate of the applied liquid results in a clean floor surface that is substantially dry after contact with the rotating pads of the dusting assembly concludes. The use of a pulse-width modulation signal as described herein can further provide for custom-tailoring of a fluid delivery rate for a variety of floor surfaces, including the adjustment of fluid dwelling times.

Yet another advantage of aspects of the disclosure relates to the configuration of the brushroll of the sweeper, the wheels of the drive mechanism and the spinning pads of the dusting assembly. By aligning the outer edges of the wheels, the brushroll and the spinning pads as shown and described above, entrainment of debris in the wheels and spinning pads is reduced thereby improving the driving and cleaning performance of the floor cleaning robot.

Still another advantage of aspects of the disclosure relate to the use of a pulse-width modulated signal to drive operation of one or more components such as the fluid pump. Such a modulated signal provides for a reduction in circuit complexity for driving the pump at a variety of flowrates, including at low flow rates, without use of a variable resistor (which can generate undesirable amounts of heat) or use of other, more complex methods of reducing the voltage provided to the pump by the battery pack.

Another advantage of aspects of the disclosure relate to the ease of access to one or more tanks within the autonomous floor cleaner, including the unitary or integrated tank assembly being selectively removable from the robot housing. Removal of a single unit can improve the ease of refilling the supply tank or cleaning out the debris receptacle without need of manipulating the entire robot 10 for a cleanout or refill operation.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. An autonomous floor cleaner, comprising:
a D-shaped housing;
a brush chamber;
a brushroll rotatably mounted in the brush chamber and wherein the brushroll is located proximate a straight-edge portion of the D-shaped housing;
a controller for controlling the operation of the autonomous floor cleaner; and
a fluid delivery system, comprising:
a supply tank for storing a supply of cleaning fluid;
at least one fluid distributor in fluid communication with the supply tank and configured to deposit cleaning fluid onto a surface to be cleaned; and
a fluid delivery pump configured to control a flow of the cleaning fluid to the at least one fluid distributor;
wherein a pulse width modulation signal powering the pump, from the controller, is further configured to provide a set flowrate of deposited cleaning fluid.

2. The autonomous floor cleaner of claim 1 wherein a housing front is defined by a rounded edge and a housing rear is defined by the straight-edge portion, and wherein a bumper assembly is provided at the housing front along at least a portion of the rounded edge.

3. The autonomous floor cleaner of claim 1, further comprising an integrated tank assembly including the supply tank and a debris receptacle and selectively removable from the D-shaped housing.

4. The autonomous floor cleaner of claim 1, further comprises a dusting assembly including at least one rotating pad driven to rotate about a vertical axis with respect to the surface to be cleaned.

5. The autonomous floor cleaner of claim 4 wherein the at least one rotating pad is selectively removable from the dusting assembly.

6. The autonomous floor cleaner of claim 1, further comprising a debris receptacle fluidly coupled to the brush chamber, wherein dirt swept up by rotation of the brushroll is moved by rotation of the brushroll through the brush chamber and propelled into the debris receptacle.

7. The autonomous floor cleaner of claim 1, further comprising a drive system for autonomously moving the autonomous floor cleaner over the surface to be cleaned based on inputs from the controller.

8. The autonomous floor cleaner of claim 1 wherein the pulse width modulation signal cyclically energizes the pump for a first predetermined time duration and then de-energizes the pump for a second predetermined time duration.

9. The autonomous floor cleaner of claim 8 wherein the first predetermined time duration is 40 milliseconds and the second predetermined time duration is 2 seconds.

10. The autonomous floor cleaner of claim 1 wherein the set flowrate ranges from 2 milliliters per second to 10 milliliters per second.

11. The autonomous floor cleaner of claim 1 wherein the pulse width modulation signal has a frequency of 50 Hz.

12. A floor cleaning robot, comprising:
an autonomously moveable housing having a front, a rear, a first side, and a second side;
a unitary assembly selectively mounted to the autonomously moveable housing, the unitary assembly comprising:
a brush chamber;
a debris receptacle fluidly coupled to the brush chamber, and
a supply tank for storing a supply of cleaning fluid;
a brushroll having a brush assembly located in the brush chamber;
at least one fluid distributor in fluid communication with the supply tank and configured to deposit cleaning fluid onto a surface to be cleaned; and
a fluid delivery pump configured to control a flow of the cleaning fluid to the at least one fluid distributor;
wherein the unitary assembly is configured to be selectively detached from the autonomously moveable housing by rotating the brush chamber with respect to the autonomously moveable housing and then lifting the unitary assembly to releasably detach the brush chamber from the autonomously moveable housing.

13. The floor cleaning robot of claim 12 wherein a pulse width modulation signal powering the fluid delivery pump is further configured to provide a set flowrate to the at least one fluid distributor.

14. The floor cleaning robot of claim 13 wherein the pulse width modulation signal cyclically energizes the pump for a first predetermined time duration and then de-energizes the pump for a second predetermined time duration.

15. The floor cleaning robot of claim 12 wherein the autonomously moveable housing is D-shaped, and wherein the brushroll is located proximate a straight edge portion of the D-shaped housing.

16. The floor cleaning robot of claim 15 wherein a housing front is defined by a rounded edge of the autonomously moveable housing and a housing rear is defined by the straight edge portion, and wherein a bumper assembly is provided at the front of the housing along at least a portion of the rounded edge.

17. The floor cleaning robot of claim 15 wherein the brushroll is selectively rotatably mounted to the autonomously moveable housing.

18. The floor cleaning robot of claim 12 wherein the debris receptacle includes a receptacle inlet open to the brush chamber such that dirt swept up by rotation of the brush assembly, is moved by rotation of the brush assembly through the brush chamber, and is propelled by rotation of the brush assembly into the debris receptacle through the receptacle inlet, which is directly adjacent the brush chamber.

19. The floor cleaning robot of claim 18, further comprising a partition having a ramped front surface provided at a bottom of the receptacle inlet to guide debris into the debris receptacle.

* * * * *